US006124065A

United States Patent [19]

Saeki

[11] Patent Number: 6,124,065

[45] Date of Patent: Sep. 26, 2000

[54] PHOTOSENSITIVE BODY AND ELECTROPHOTOGRAPHIC PRINTER USING THE SAME

[75] Inventor: Tomoya Saeki, Niigata, Japan

[73] Assignee: NEC Corporation, Japan

[21] Appl. No.: 09/135,666

[22] Filed: Aug. 18, 1998

Related U.S. Application Data

[60] Provisional application No. 60/057,148, Aug. 28, 1997.

[30] Foreign Application Priority Data

Aug. 20, 1997 [JP] Japan ..... 9-223999

[51] Int. Cl.[7] ..... G03G 5/147; G03G 15/00

[52] U.S. Cl. ..... 430/66; 430/67; 399/147; 399/162

[58] Field of Search ..... 430/66, 67; 399/147, 399/162

[56] References Cited

U.S. PATENT DOCUMENTS 3,856,548 12/1974 Taylor et al. ..... 430/66

FOREIGN PATENT DOCUMENTS 58-126538 7/1983 Japan ..... 430/66
61-3185 1/1986 Japan .
2-39272 3/1990 Japan .
3-105376 5/1991 Japan .
3-44299 7/1991 Japan .
4-270342 9/1992 Japan ..... 430/66
5035125 of 1993 Japan .
6-102714 4/1994 Japan .

*Primary Examiner*—Roland Martin
*Attorney, Agent, or Firm*—Ostrolenk, Faber, Gerb & Soffen, LLP

[57] ABSTRACT

The present invention provides a photosensitive body and an electrophotographic printer capable of notifying an operating whether a protection film 15 is correctly peeled off from a photosensitive surface 1*a* of the photosensitive body. The protection film 15 has marks 15*a* and 15*b* to be automatically detected. The electrophotographic printer 100 comprises a peel member 13, a guide route for guiding the peeled off protection film out of the printer, a magnetic sensor 14 for detecting the marks 15*a* and 15*b*, and a control circuit 17 for deciding according to an output of the magnetic sensor whether the protection film is correctly peeled off and outputting the decision result through a liquid crystal display panel 19. This enables an operator to know about the peeling state.

43 Claims, 9 Drawing Sheets

PHOTOSENSITIVE BODY AND ELECTROPHOTOGRAPHIC PRINTER USING THE SAME

This application claims priority under 35 USC §119 (e) (1) of provisional application Ser. No. 60/057,148, filed Aug. 28, 1997.

BACKGROUND OF THE INVENTION

1. Field of the Invention

The present invention relates to a photosensitive body and an electrophotographic printer using the photosensitive body.

2. Description of the Related Art

Conventionally, an electrophotographic printer uses a photosensitive body which is has a drum or tube shape or an endless belt mounted on rollers. The drum or tube type photosensitive body has a photosensitive surface on its outer circumference. The belt type photosensitive body has a photosensitive surface on one of its sides.

In the conventional electrophotographic apparatus, a printing operation is carried out as follows. Firstly, all the charges remaining on a photosensitive surface from a preceding printing are erased by being exposed to an erase lamp. Next, an electric charge is uniformly applied to the photosensitive surface by a corona or a charge roll. After this, a laser beam or LED light is applied to the photosensitive surface so as to form an electric charge distribution corresponding to an image to be printed. Toner is attracted to this photosensitive surface corresponding to this charge distribution, forming a toner image. This toner image is transferred directly or through an intermediate medium onto a recording medium such as a paper sheet and a film.

In this electrophotographic printer, after repetition of image forming, the photosensitive body is deteriorated electrically or thermally. Accordingly, the photosensitive body need to be replaced periodically. The photosensitive body is an important component which directly affects an image formation process. Consequently, when storing or replacing a photosensitive body, countermeasures should be take against possible damages due to dust and deterioration due to sunlight or room illumination.

To cope with this, the photosensitive surface is covered with a protection film, which is peeled off after the photosensitive body is mounted on a printer apparatus. However, peeling off of this protection film is a troublesome work if it should be carried out manually with care not to expose the photosensitive body to an external light.

Japanese Patent, Publication of Examined Application, B2-3-44299 discloses an invention for automatic removal of this protection film. That is, the protection film is wound up by a roller and discharged out of a printer apparatus.

However, the aforementioned invention only peels off and discharges the protection film from the printer apparatus as its purpose. If any trouble has occurred during the peeling-off or discharge operation inside the printer apparatus, an operator cannot know the state inside.

Moreover, it is difficult to check the deterioration degree of the photosensitive body provided inside the electrophotographic printer and there has been a problems that a printed image is deteriorated without knowing.

SUMMARY OF THE INVENTION

It is therefore an object of the present invention to provide a photosensitive body and an electrophotographic printer capable of reporting an operator whether a protection film for protecting a photosensitive surface is normally removed.

The photosensitive body according to the present invention may be an endless belt type having a protection film to cover a photosensitive surface provided on its outer surface. The protection film has a leading end and trailing end. The protection belt is adhered to the photosensitive surface except for a non-adhered portion at the leading end. When a predetermined tension is applied to this non-adhered portion in a direction to peel off the protection film from the photosensitive surface, the protection film is easily peeled off from the photosensitive surface. Furthermore, the film has on its surface a marked portion which can be detected magnetically or optically.

The aforementioned photosensitive body may have a drum shape.

Moreover, the electrophotographic printer includes the aforementioned photosensitive body which can detachably be mounted on the printer; a peel-off member for peeling off a protection film from a photosensitive surface of the photosensitive body; a guide route for guiding the protection film out of the electrophotographic printer; a roller to move the protection film in the guide route; and a magnetic sensor or a photo sensor for detecting a marked portion of the protection film.

When a new photosensitive body is mounted on this electrophotographic printer, the photosensitive body is rotated or circulated and the non-adhered portion at the leading end of the protection film is brought into contact with a slanting surface of the peel-off member that is provided in the vicinity of the photosensitive surface. This non-adhered portion slides along the slanting surface and is guided toward the guide route. This non-adhered portion is further fed to a downstream side of the guide route by a feed roller. Thus, the protection film is subjected to a tension in the direction to be peeled off from the photosensitive surface. The protection film is further fed by the feed roller and completely peeled off from the photosensitive surface and discharged outside.

Here, the marked portion of the protection film is detected by a magnetic sensor or photo sensor provided in the guide route. This detection reports an operator that the film discharge is being normally carried out.

Moreover, according to another aspect of the present invention, a service life of the photosensitive body is able to be reported to an operator.

For this, the electrophotgrpahic printer according to the present invention comprises a control circuit for controlling a printing operation and a replacement display unit for notifying that the photosensitive body is to be replaced. The control circuit has a counter function for incrementing a sheet count when a printing is carried out on a printing sheet; an initialization function for initializing the counter function to 0 upon detection of the marked portion of the protection film; and a replacement display function for prompting a display unit to display a replacement note when the counter function has exceeded a predetermined count value.

With this configuration, when a predetermined number of sheets are printed as a service life of the photosensitive body, the replacement display unit displays a note indicating that the photosensitive body is to be replaced. Accordingly, it is possible to prevent deterioration of a printed image because of overwork of the photosensitive body.

DESCRIPTION OF THE PREFERRED EMBODIMENTS

Hereinafter, description will be directed to an electrohpotographic printer 100 with reference to the attached drawings.

Figure 1:
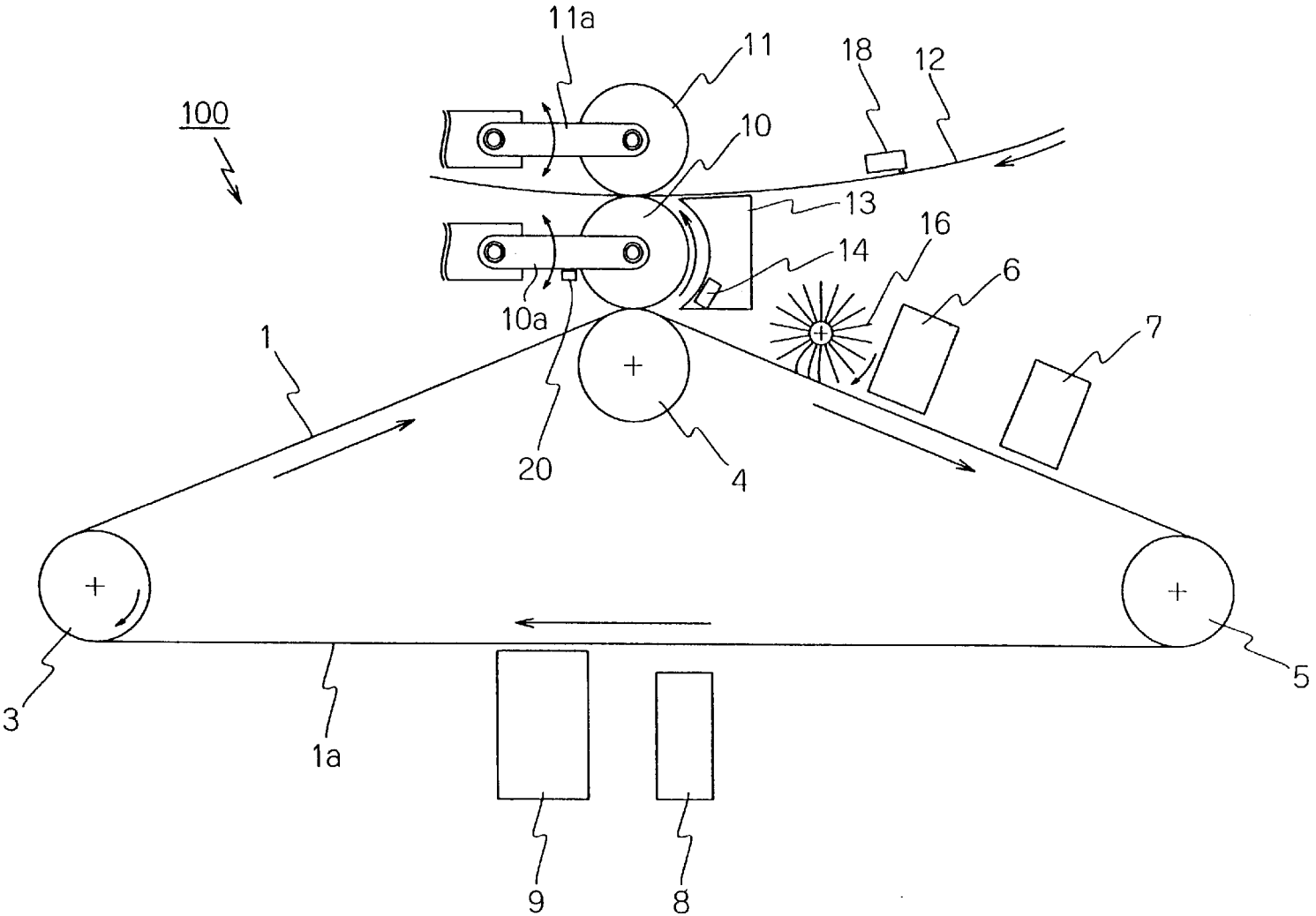
FIG. 1 shows a basic configuration of an electrophotographic printer having an endless belt type photosensitive body according to the present invention.

As shown in FIG. 1, the electrophotographic printer 100 has an endless belt type photosensitive body (which will be referred to as a photosensitive belt) 1 which is supported by three rotation rollers 3, 4, and 5. These rollers 3, 4, and 5 are in contact with an inner surface of the photosensitive belt 1. Because the photosensitive belt 1 is supported by the rollers 3, 4, and 5 with a certain tension, the photosensitive belt 1 is fed according to rotation of the roller 3 alone. The arrows in FIG. 1 show the feed direction obtained by this rotation.

The photosensitive belt 1 has on its outer surface a photosensitive surface 1*a*. Between the roller 4 and the roller 5, there are provided an electric eraser 6 and an electric charger 7 in this order from the upstream of the feed direction. The electric erase 6 and the electric charger 7 are arranged in proximity to the photosensitive surface 1*a*. The electric eraser 6 removes an electric charge residue left by a preceding printing. The electric charger 7 is, for example, a corona discharge device that applies an electric charge uniformly over the photosensitive surface 1*a*.

Between the roller 5 and the roller 3, there are provided an exposure unit 8 and a development unit 9 in this order from the upstream of the feed direction. The exposure unit 8 and the development unit 9 are arranged in proximity to the photosensitive surface 1*a*. This exposure unit 8 forms an electrostatic latent image corresponding to an image to be printed on the photosensitive surface 1*a*. The exposure unit 8 comprises a light source such as a semiconductor laser and an LED, a polygonal mirror for scanning the radiated light, and a collimator lens (which are not depicted).

The development unit 9 contains a toner which is applied to the electrostatic latent image via a development roller (not depicted) arranged in the proximity to the photosensitive surface 1*a*. Thus, a toner image corresponding to an image to be printed is formed on the photosensitive surface 1*a*.

A transfer roller 10 is arranged adjacent to the roller 4. The photosensitive belt 1 is fed between this transfer roller 10 and the roller 4. The transfer roller 10 generates an electric field to attract the toner onto its circumferential surface. Thus, the toner image is entirely transferred onto the circumferential surface of the transfer roller 10.

Moreover, the transfer roller 10 is sandwiched between the roller 4 and a fixation roller 11. A recording sheet 12 is fed by a feed roller (not depicted) so as to pass between the transfer roller 10 and the fixation roller 11.

The fixation roller 11 comprises a built-in heater so as to heat the toner adhered to the transfer roller 10. The fixation roller 11 is in contact with the transfer roller 10 so as to be pressed against each other. Accordingly, the toner melted by the heat applied by the heater is pressed against the recording sheet 12 passing between the fixation roller 11 and the transfer roller 10. Thus, the toner is entirely transferred to the recording sheet 12, completing a printing.

Moreover, the transfer roller 10 and the fixation roller are supported by arms 10*a* and 11*a*, respectively. These arms 10*a* and 11*a* can be rotated in the directions indicated by the arrows in FIG. 1. Each of the arms 10*a* and 11*a* has a coil spring (not depicted) functioning to press the transfer roller 10 and the fixation roller 11, respectively, toward the roller 4. Accordingly, it is possible to increase a clearance between the roller 4 and the roller 10 and a clearance between the roller 10 and the roller 11.

Between the transfer roller 10 and the electric eraser 6, there is provided a brush-shaped cleaner 16. This clear 16 has a brush end in contact with the photosensitive surface 1*a* and is rotated in a direction opposite to the feed direction. Thus, the toner remaining on the photosensitive surface 1*a* is cleaned.

As has been described above, the photosensitive belt 1 can be detached and attached by placing the transfer roller 10 and the fixation roller apart from the roller 4. The photosensitive belt 1 is an expendable item which is deteriorated as is used. After deterioration to a certain degree, the photosensitive belt need to be replaced with a new one.

Figure 2A:
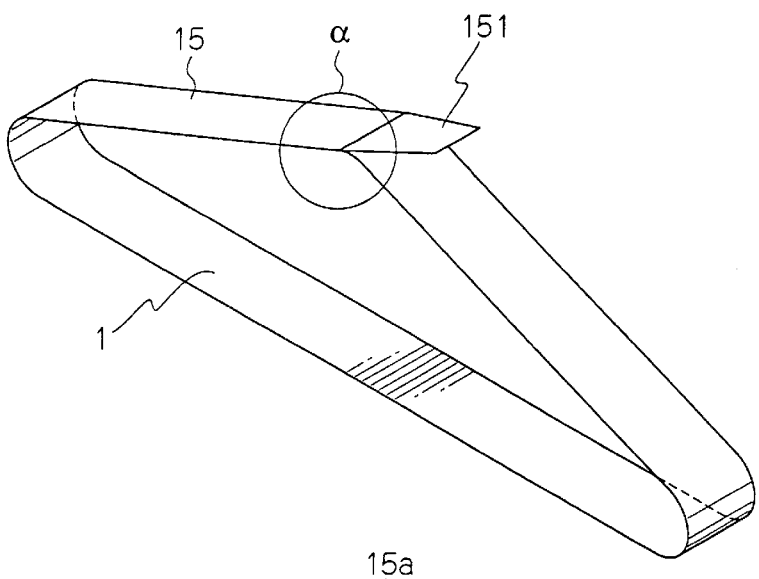
FIG. 2A is a perspective view showing a photosensitive body covered with a protection film.
Figure 2B:
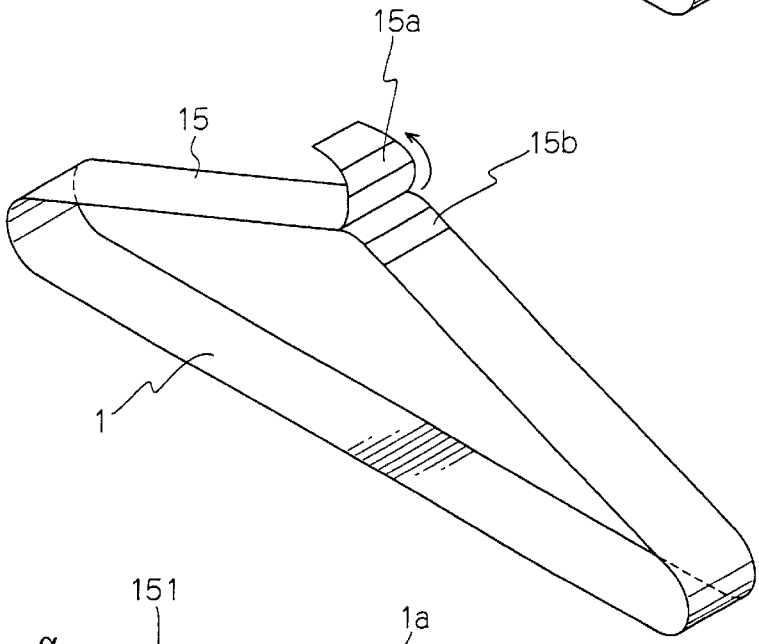
FIG. 2B shows a marked portion to be detected.

FIG. 2A shows the photosensitive belt 1 before mounted on the electrophotographic printer 100. The photosensitive belt 1 is comparatively small in this figure but may be set to a greater width.

Figure 2C:
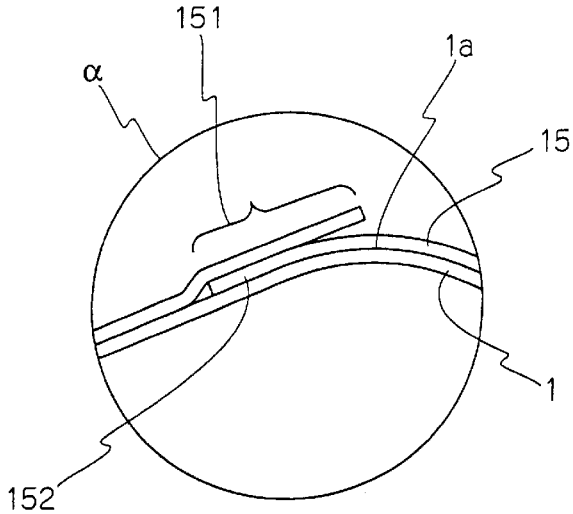
FIG. 2C is an enlarged view showing a portion α in FIG. 2A.

FIG. 2C is an enlarged view showing a portion α in FIG. 2A. As shown here, the photosensitive belt 1 is covered with a protection film 15. The photosensitive belt 1 covered with this protection film 15 is mounted on the electrophotographic printer 100. This protection film is characterized by the following features.

Firstly, the protection film 15 is in close contact with the photosensitive surface 1*a*. That is, the protection film 15 has a weak adhesive painted on a surface to be contact with the photosensitive surface 1*a*. This adhesive is painted on the protection film with a thickness in the order which prevents natural peel off of the protection film 15 from the photosensitive surface 1*a*.

The protection film 15 is adhered to the photosensitive surface 1*a* along the feed direction by the electrophotographic printer 100. This film 15 has a leading end portion 151 at the upstream side and a trailing end portion 152 at the downstream side of the feed direction. This leading end portion 151 has no adhesive painted and not adhered to the photosensitive surface 1*a*.

Consequently, if a predetermined tension is applied to the leading end portion 151 in the direction apart from the photosensitive surface 1*a*, the protection film 15 is easily peeled off.

The protection film 15 is made from a polyethylene terephthalate (PET). The leading end portion 151 is defined to have a thickness of 75 [μm] and the rest of the film is set to have a thickness of 38 [μm]. Thus, the leading end portion has an increased elasticity than the remaining portion of the film. The remaining portion has an outer surface painted by a black paint for light shading.

Furthermore, the leading end portion 151 has a mark 15*a* consisting of a magnetic material of iron oxide layer. Similarly, the trailing end portion 152 has a mark 15*b* identical to the mark 15*a*. These marks 15*a* and 15*b* are detected by a magnetic sensor 14 (FIG. 1) which will be detailed later.

Figure 3:
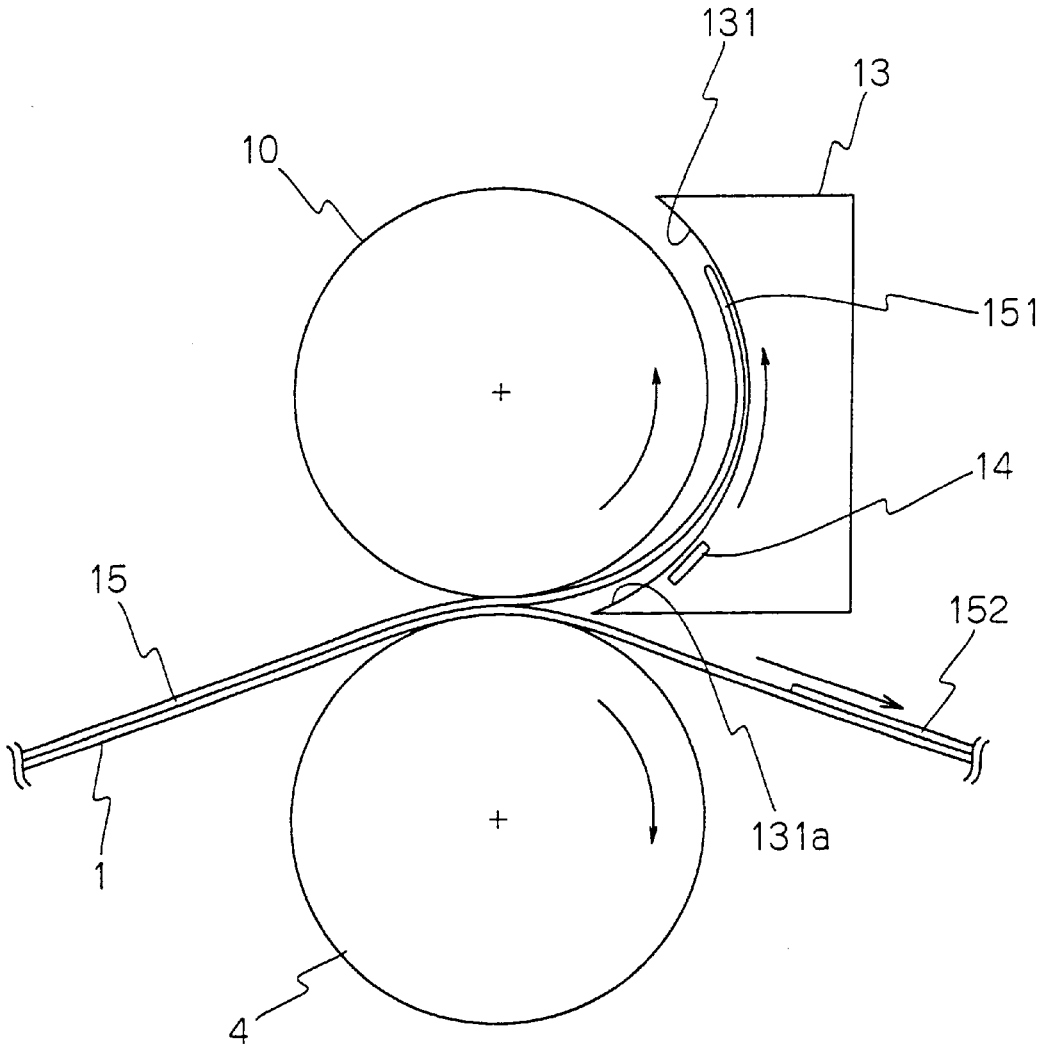
FIG. 3 is a side view showing the photosensitive body from which a protection film is being peeled off.

In the vicinity of the aforementioned transfer roller 10, there is provided a peel member 13 for peeling off the protection film 15 from the photosensitive surface 1*a*. As shown in FIG. 3, this peel member 13 has a curved plane 131 along the circumference of the transfer roller 10. This curved plane 131 and the circumference of the transfer roller 10 define a guide route for the protection film 15 peeled off from the photosensitive surface 1*a*. The peel member 13 has a bottom formed in a wedge shape having an end pointed to the downstream side of the contact portion between the transfer roller 10 and the roller 4. The wedge shape has an upper side 131*a* that is continuous to the aforementioned curved plane 131.

Referring back to FIG. 1, when the photosensitive belt 1 is mounted on the rollers 3, 4, and 5 so as to be fed, the photosensitive belt 1 curved by these rollers 3, 4, and 5. When the leading end portion 151 passes between the roller 4 and the transfer roller 10, the photosensitive belt 1, the photosensitive belt 1 is curved along the roller 4 while the leading end portion 151 is removed from the photosensitive surface 1*a* by its elasticity. That is, there is generated a clearance between the leading end portion 151 and the photosensitive belt 1, and the wedge-shaped bottom of the aforementioned peel member 13 is inserted into this clearance. Thus, the leading end portion 151 is fed along the curved plane 131. Here, the roller 4 and the transfer roller 10 serve as feed rollers for the protection film.

Thus, the protection film 15 is peeled off from the photosensitive belt 1 by the peel member 13. The peeled off protection film 15 passes between the transfer roller 10 and the fixation roller 11 and discharged out of the printer in the same way as the recording sheet The peel member 13 comprises on its curved plane 131 a magnetic sensor 14. The magnetic sensor 14 is a coil where a constant current flows for magnetic detection. When the mark 15*a* or 15*b* of the protection film 15 passes by this magnetic sensor 14, a change is caused in the magnetic field, and the passage of the mark 15*a* or 15*b* is detected.

A detection signal from this magnetic sensor 14 is outputted to a control circuit 17 that carries out an operation control of respective components of the electrophotographic printer 100.

Moreover, as shown in FIG. 1, in the feed passage of the recording sheet 12, a sheet sensor 18 is provided for detecting passage of a recording sheet. This sheet sensor 18 is a limit switch that is turned on when pressed by the recording sheet 12 and a detection signal is outputted to the control circuit 17.

Furthermore, a photosensitive body sensor 20 is provided in the vicinity of the arm 10*a* of the transfer roller 10. This photosensitive body sensor is a limit switch that is turned on when pressed by the arm 10*a*, so that a detection signal is outputted to the control circuit 17.

Figure 4:
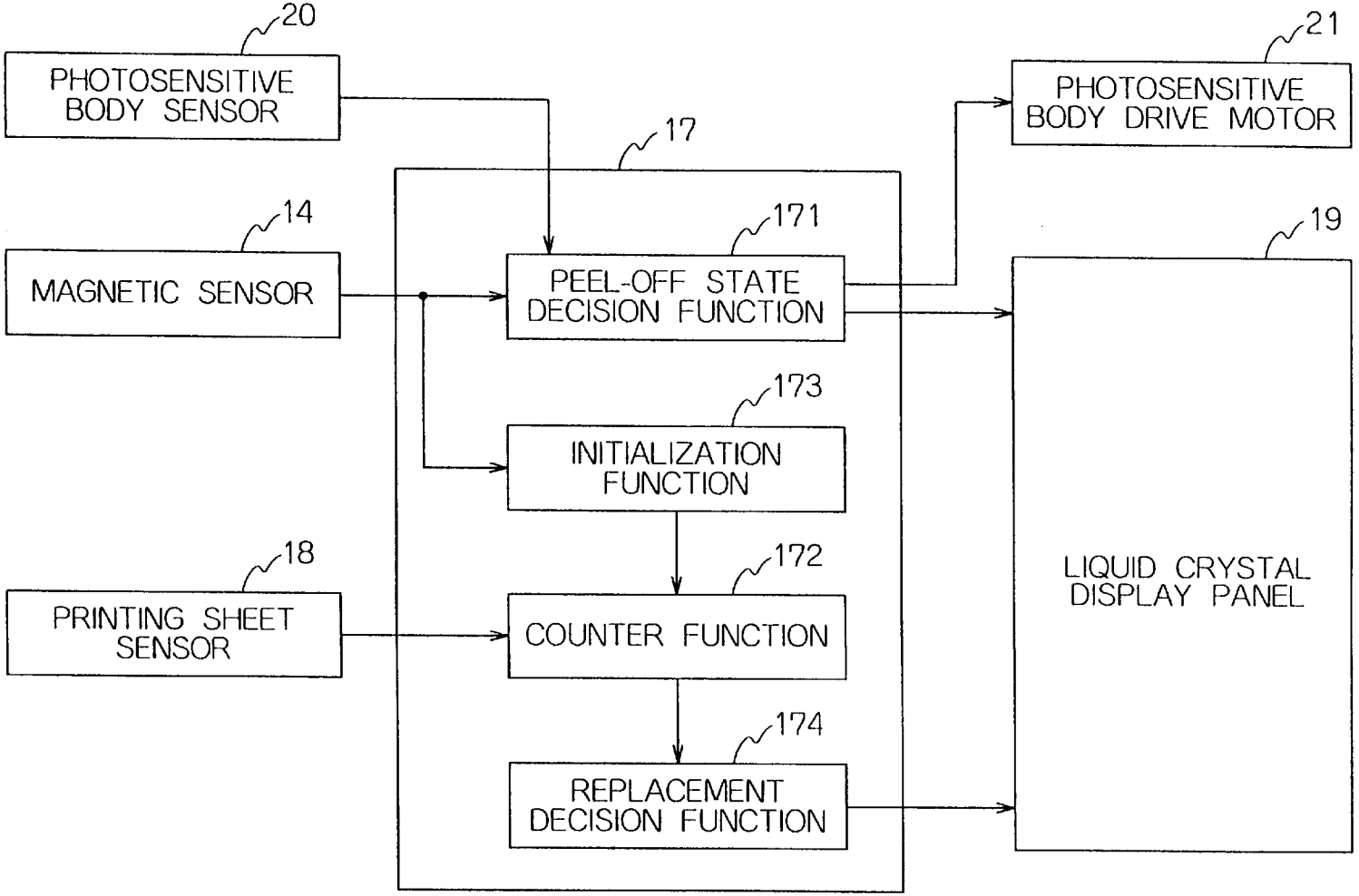
FIG. 4 is a block diagram showing a control circuit of the electrophotographic printer according to the present invention.

FIG. 4 is a block diagram showing a basic configuration of this control circuit 17.

The control circuit 17 is a CPU that executes a control program for carrying out functions of the control circuit.

The control circuit 17 has four functions as follows:

(1) Peel-off state decision function 171: According to presence or absence of a detection signal from the magnetic sensor, a liquid crystal display panel 19 is controlled to display whether the protection film 15 has been peeled off normally.

(2) Counter function 172: Upon reception of a detection signal from the sheet sensor 18, a printed sheet count is incremented by one.

(3) Initialization function 173: Upon reception of a detection signal from the magnetic sensor 14, the count of counter function 172 is initialized to 0.

(4) Replacement decision function 174: When the sheet count of the counter function 172 exceeds a predetermined count, the liquid crystal display panel 19 is controlled to display a message that the photosensitive belt 1 should be replaced.

The aforementioned peel-off state function 171 operates as follows. When mounting a new photosensitive belt 1, the transfer roller 10 is shifted upward. Here, the arm 10*a* switches the photosensitive body sensor from ON to OFF. When the photosensitive belt 1 is mounted, the transfer roller 10 is shifted downward and the photosensitive body sensor 20 is again switched to ON. At this moment, the photosensitive body sensor 20 produces an output signal. Upon reception of this signal, the peel-off state decision function 171 drives a photosensitive body drive motor 21 for a predetermined time. This predetermined time is preferably a time required for three or four turns of the photosensitive belt 1, for example.

When the protection film 15 is peeled off and introduced between the transfer roller 10 and the peel member 13, firstly, the mark 15*a* is detected and after a predetermined time, the mark 15*b* is detected. Thus, if the both end portions of the protection film 15 have passed by the magnetic sensor 14, it can be considered that the peeling off is carried out normally. Accordingly, when a detection signal is from the magnetic sensor 14 is received twice, the peel-off state decision function 171 decides that the protection film 15 has been peeled off normally and the liquid display panel 19 displays a message for the normal peel-off.

On the other hand, if no detection signal is received from the magnetic sensor 14, it is considered that the protection film 15 has not been peeled off normally and the liquid crystal display panel 19 displays a message for the error.

Next, the aforementioned replacement decision function 174 operates as follows. As has been described above, the photosensitive belt 1 is deteriorated while used and its service life is limited. For example, by using as samples some of the photosensitive belts 1 which are produced by a mass production and carrying out a durability test of the samples, it is possible to roughly define a number of printed sheets obtained during a service life of the samples.

The counter function 172 is controlled by the initialization function 173 to start counting a number of printed sheets immediately after the photosensitive belt 1 is replaced. When the count of the counter function exceeds the defined number, the replacement decision function 174 decides that the service life of the photosensitive belt 1 has ended and controls the liquid crystal display panel 19 to display a message for that.

The aforementioned liquid crystal display panel 19 is provided outside of a casing of the electrophotographic printer 100 and can display messages "Photosensitive body normal", "Photosensitive body error", and "Replace photosensitive body".

Figure 5:
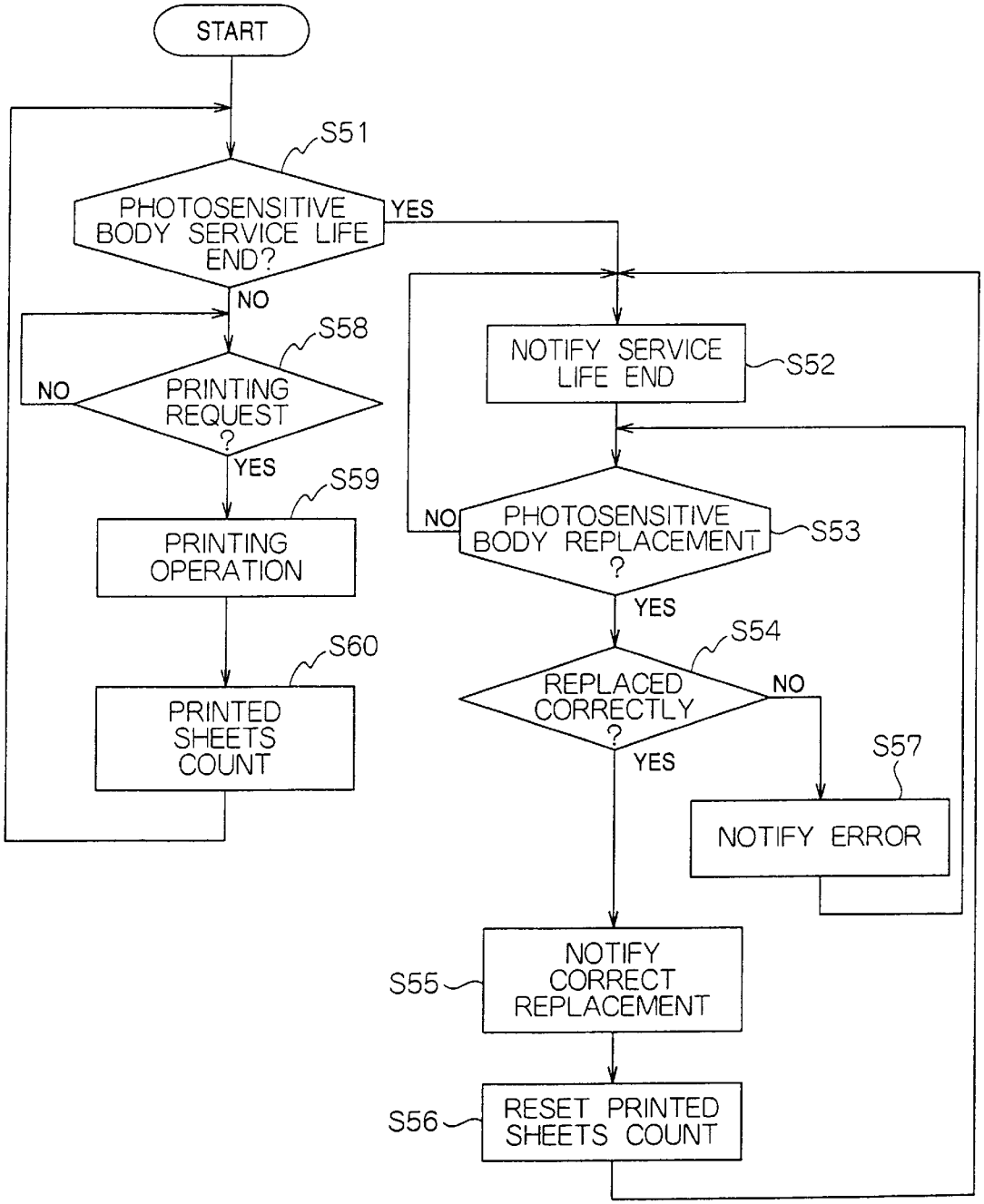
FIG. 5 is a flowchart showing an operation procedure of the electrophotographic printer.

FIG. 5 is a flowchart showing operation of the electrophotgraphic printer 100 having the aforementioned configuration.

Firstly, at operation start, the replacement decision function 174 decides whether the photosensitive belt 1 still has a service life according to the count of the counter function 173 (step S51).

If the photosensitive belt 1 has a service life expired, the liquid crystal display panel 19 shows a message "Replace photosensitive body" (step S52).

When the photosensitive belt 1 is replaced with a new one, the peel-off state decision function 171 decides whether the replacement is completed normally (step S54).

If the replacement is completed normally, then the liquid crystal display panel 19 shows the message "Photosensitive body normal" (step S55).

Simultaneously with this, the initialization function 173 resets the count of the counter function 172 to 0 (step S56). Control is returned to step S51 to decide whether the photosensitive belt 1 still has a service life.

On the other hand, if it is decided that the replacement of the photosensitive belt 1 has caused an error, the peel-off state decision function 171 controls the liquid crystal display panel 19 to display the message "Photosensitive body error" (step S57). When the photosensitive belt 1 is mounted correctly, control is returned to step S53 to make the decision whether the photosensitive belt 1 is replaced correctly.

If step S51 decides that the photosensitive belt 1 still has a service life, the control circuit enters a wait state for receiving a print request signal from outside (step S58).

When a printing is requested, the aforementioned printing operation is started (step S59).

During this printing, when passage of a recording sheet 12 is detected by the sheet sensor 18, the counter function 18 increments its count by one (step S60).

Control is again returned to step S51 to decide whether the photosensitive belt 1 still has a service life.

As has been described above, the photosensitive belt 1 is covered by the protection film 15 and can protect the photosensitive surface 1*a* from an external light and adhesion of dust, thus preventing deterioration of a printed image.

Moreover, the electrophotgraphic printer 100 according to the present invention has the peel member 13 which automatically peels off the protection film 15 from the photosensitive surface 1*a,* eliminating the troublesome manual removal and enhancing the operationability. Moreover, because the protection film 15 is removed inside the electrophographic printer, it is possible to effectively prevent radiation of an external light and adhesion of dust.

Furthermore, the protection film 15 has marks 15*a* and 15*b* and it is possible to detect with the magnetic sensor 14 whether the peeled off protection film 15 is fed through a predetermined passage. Accordingly, the peel-off state decision function 17 of the control circuit 17 can decide whether the protection film 15 has been peeled off correctly. Furthermore, according to this decision result, a corresponding message appears on the liquid crystal display panel 19 so that an operator can readily know the situation inside the printer.

Moreover, according to the replacement decision function 174 of the control circuit 17, when the photosensitive belt 1 is used for printing on a predetermined number of printing sheets, it is displayed as a service life on the liquid crystal display panel 19. Accordingly, an operator can visually know when the service life of the photosensitive belt 1 has expired. This prevents to produce a deteriorated printed image.

It should be noted that in the aforementioned example, the peel-off state and the service life of the photosensitive belt 1 are indicated through the liquid crystal display panel 19, but they can also be indicated by other methods as follows.

(a) Lamps corresponding to the messages are turned on.

(b) Loud speaker outputs a sound information corresponding to the messages.

(c) A buzzer produces a sound information corresponding to the messages.

(d) A signal generation circuit is provided for generating an information signal corresponding to the messages, so that the information signal is transmitted from the electrophotographic printer to another apparatus (such as a personal computer) connected to a network connecting the electrophotgraphic printer.

Moreover, in the aforementioned example, the protection film 15 has two marks 15*a* and 15*b* provided at end portions of the protection film 15 but they can also be provided at an intermediate positions. Moreover, the protection film 15 may have only one mark.

Figure 6:
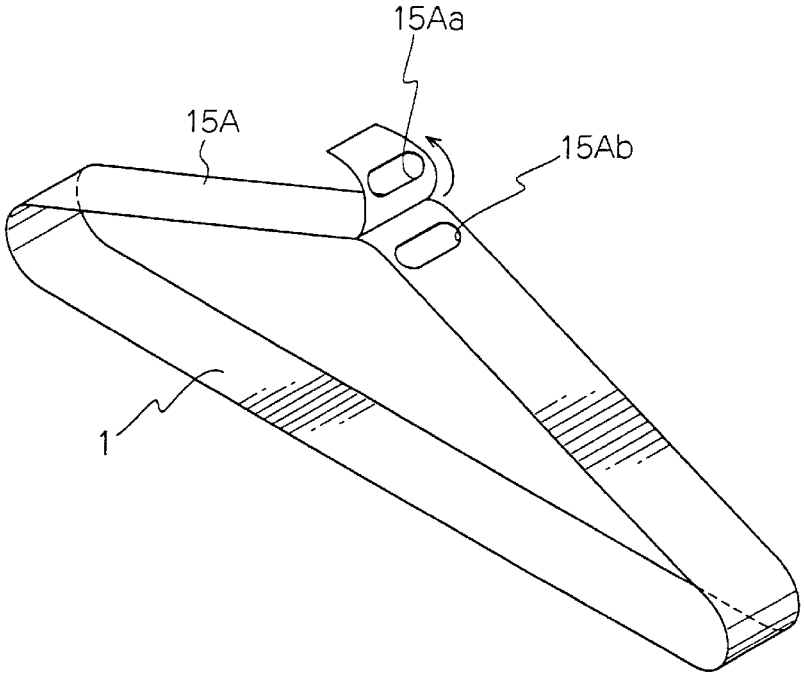
FIG. 6 shows another example of marked portion on the protection film.
Figure 7:
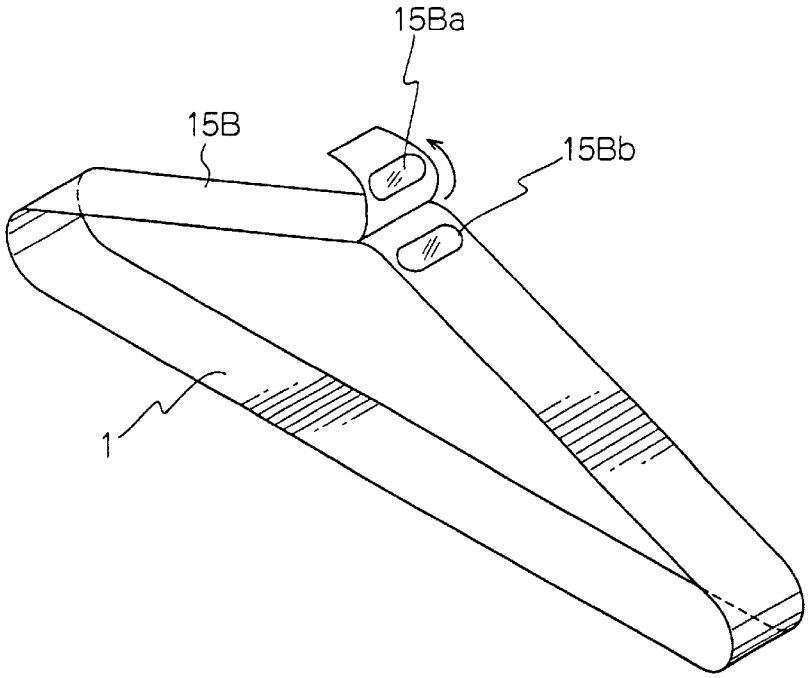
FIG. 7 shows still another example of marked portion on the protection film.

The aforementioned marks 15*a* and 15*b* are not limited to magnetic material layers, but may be any marks if they can be detected comparatively easily. For example, they may also be marks which can be detected optically. FIG. 6 and FIG. 7 show examples of such marks.

FIG. 6 shows through holes formed at both end portions of a protection film as marks 15A*a* and 15A*b*. Moreover, these through holes may be replaced by a transparent material. It is preferable that the protection film excluding the marks be colored black or a color different from that of the transfer roller 10.

FIG. 7 shows marks 15B*a* and 15B*b* formed by a light reflection film at the same position as the aforementioned marks 15A*a* and 15A*b*. It is preferable that the protection film excluding the marks 15B*a* and 15B*b* be painted black or a color which does not reflect a light.

When a light is applied to the protection film, these marks 15A*a,* 15A*b,* and marks 15B*a,* 15B*b* are detected by a change of illuminance of a reflected light.

Figure 8:
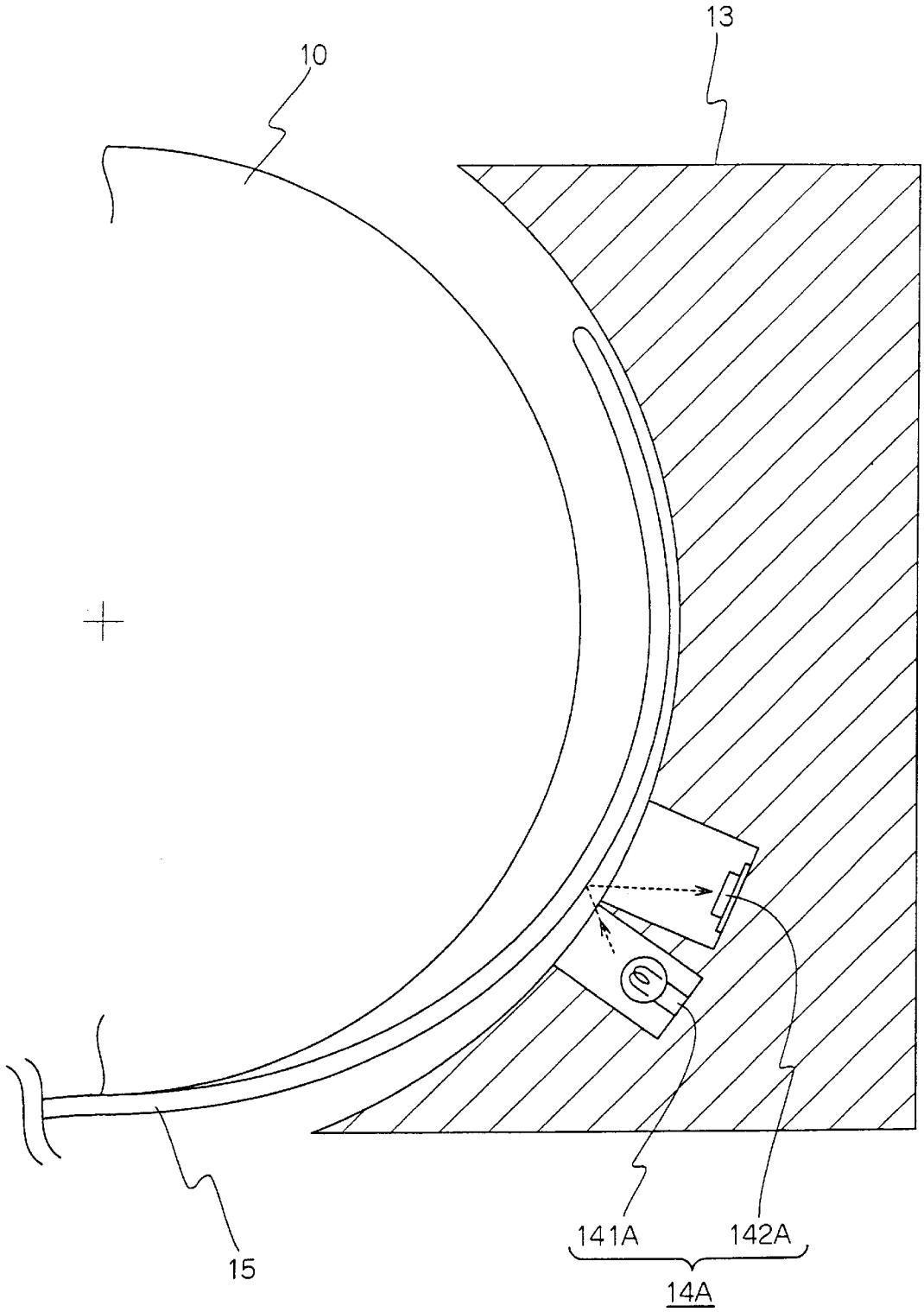
FIG. 8 shows a configuration of a photo sensor.

For this detection, the peel member 14 comprises a photo sensor 14A instead of the aforementioned magnetic sensor 14. As shown in FIG. 8, this photo sensor 14A consists of a light source lamp 141A and a photo diode 142A. Normally, while the light source lamp 141A is ON, the photo diode 142A receives a reflected light from the transfer roller 10. However, when the photosensitive body is mounted on the electrophotographic printer and the protection film 15A (or 15B) with the mark 15A*a* (or 15B*a*) passes, the light is reflected from the portection film 15A (or 15B) while changing its luminance when reflected from the mark 15A*a* (or 15B*a*). This luminance change causes a corresponding detection current change. According to this current change, the control circuit 17 recognizes detection of the mark 15A*a* (or 15B*a*). Thus, similar processing is carried out as in the aforementioned magnetic sensor.

Figure 9:
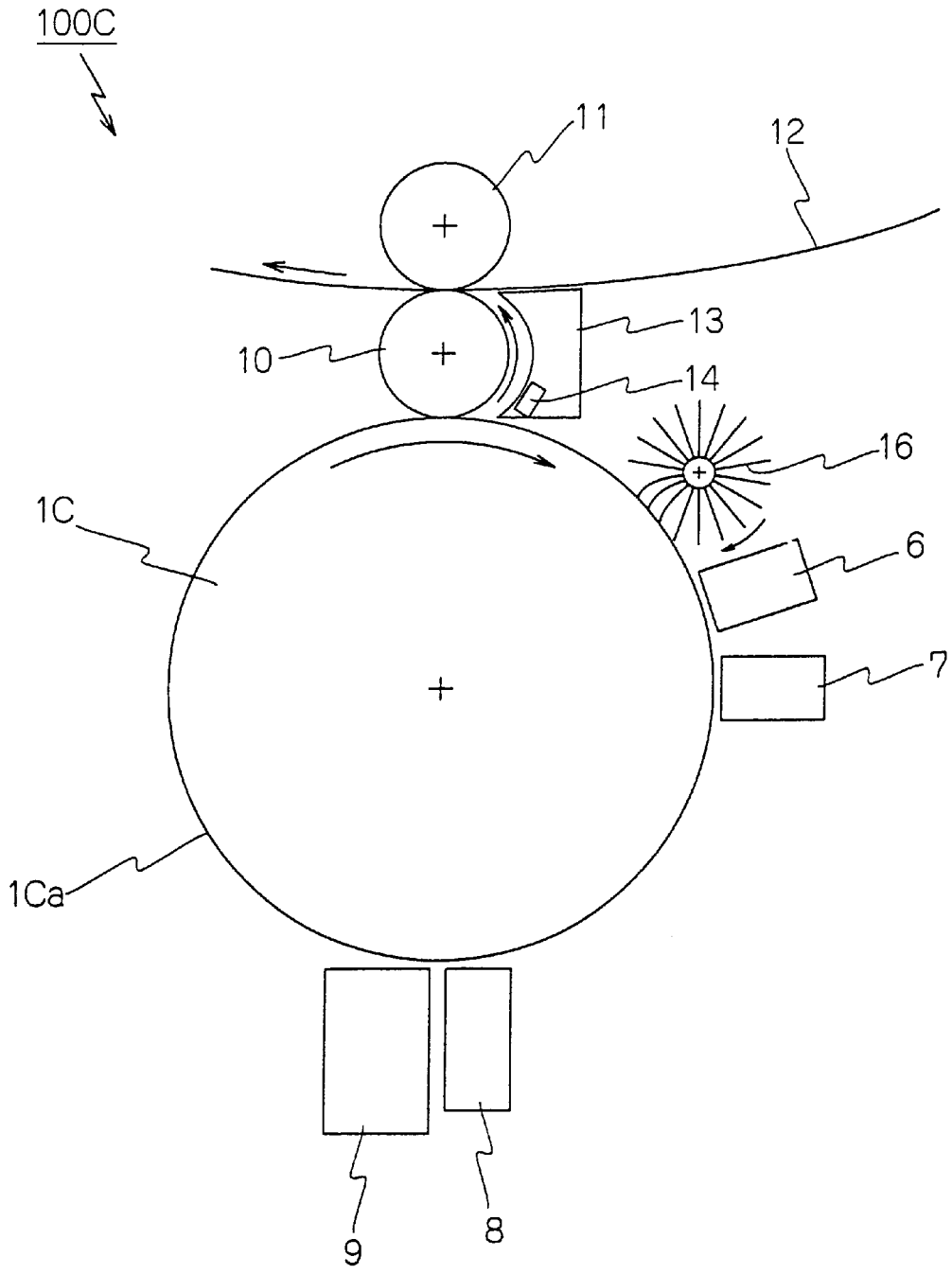
FIG. 9 shows a basic configuration of an electrophotographic printer having a drum type photosensitive body according to the present invention.

Moreover, the aforementioned photosensitive body is not limited to a belt type but the present invention can also be applied to a drum type photosensitive body (hereinafter, referred to as a photosensitive drum) 1C. Explanation will be given on an example of the electrophotographic printer comprising this photosensitive drum 1C with reference to FIG. 9 and FIG. 10. Like components as in the example using the belt type photosensitive body are denoted with like reference numerals and their explanations are omitted.

The photosensitive drum C1 has a cylindrical shape and its circumeferntial surface serves as a photosensitive surface 1C*a*. The photosensitive surface 1C*a* is surrounded by a fixation roller 10, a peel member 13, a cleaner 16, an electric eraser 6, an electric charger 7, an exposure unit 8, and a development unit 9 arranged in this order.

Moreover, The photosensitive drum 1C has a sufficient rigidity against a contact pressure applied from the development unit 9 and the transfer roller 10. The photosensitive drum 1C is rotated by a drive motor (not depicted) a t a constant velocity.

Figure 10A:
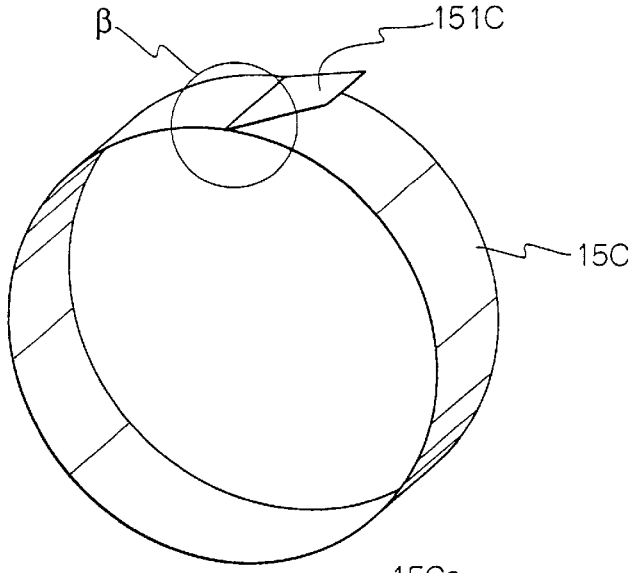
FIG. 10A is a perspective view showing a protection film for a drum type photosensitive body.

FIG. 10A shows a protection film 15C for covering a photosensitive surface 1C*a* of the photosensitive drum 1C. This film 15C is made from the same material and has the same configuration as the aforementioned protection film 15. That is, the film is adhered to the photosensitive surface 1C*a* by a weak adhesive which enables to peel off the protection film 15 from the photosensitive surface 1C*a*. Moreover, the protection film 15C has a leading end portion 151C and a trailing end portion 152C at the upstream side and the downstream side of the photosensitive drum 1C, respectively. The leading end portion 151C is not adhered to the photosensitive surface 1C*a* and has a greater thickness and a higher elasticity than the remaining portion of the protection film. Accordingly, the leading end portion 151C is apart from and raised to a certain degree from the photosensitive 1C*a* (see FIG. 10A, FIG. 10C).

Figure 10B:
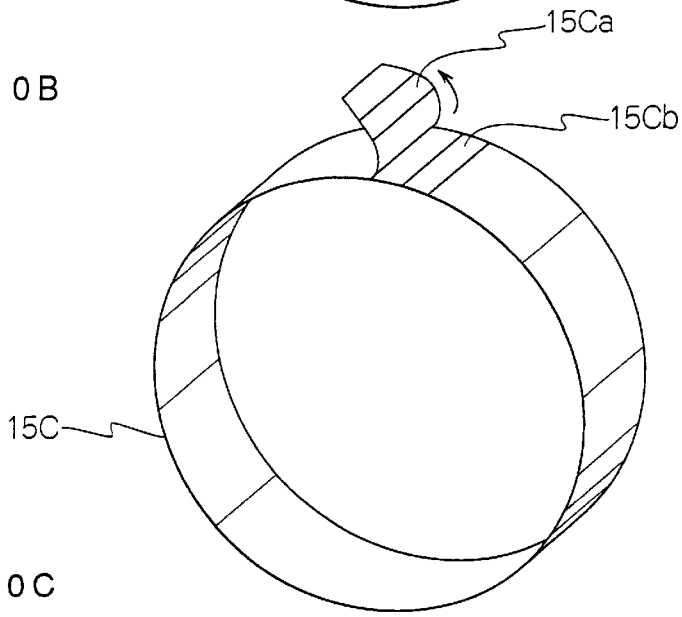
FIG. 10B shows a marked portion on the protection film.
Figure 10C:
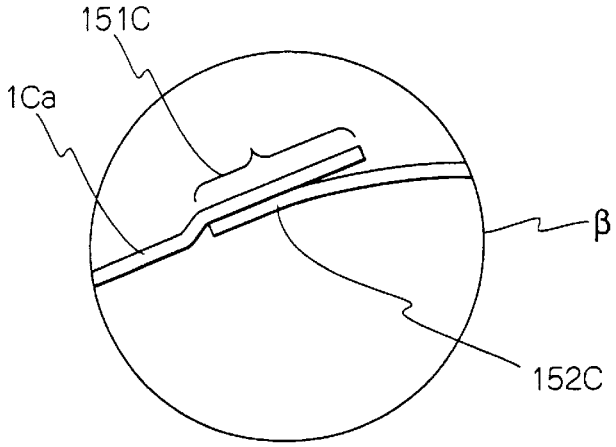
FIG. 10C is an enlarged view of a portion β in FIG. 10A.

At the leading end portion 151C and the trailing end portion 152C, there are forms marks 15C*a* and 15C*b* made from an iron oxide layer as shown in FIG. 10B.

The electrophotographic printer 100C having the aforementioned configuration can obtain the same effect by the same operation as the aforementioned electrophotographic printer 100.

Here, the marks 15C*a* and 15C*b,* like the aforementioned marks in FIG. 6 and FIG. 7, may be made as through holes, a transparent material, or a light reflecting film. In this case, the electrohotograohpic printer uses an optical sensor 14A instead of the magnetic sernsor 14.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 09-223999 (Filed on Aug. 20$^{th}$, 1997) including specification, claims, drawings and summary are incorporated herein by reference in its entirety.

What is claimed is:

1. A rotary type photosensitive body to be monted on an electrophotographic printer and having on its outer circumference a photosensitive surface covered with a protection film characterized as follows:

(a) entirely adhered to said photosensitive surface except for one end portion;

(b) capable of being peeled off from said photosensitive surface; and (c) having on its surface a mark to be detected by said electrophotographic printer.

2. An endless belt type photosensitive body to be mounted on an electrophotographic printer so as to be fed in a predetermined direction and having on its outer surface a photosensitive surface that is covered with a protection film characterized as follows:

(a) having a first end portion and a second end portion at the upstream side and the downstream side of said feed direction and entirely adhered to said photosensitive surface except for said first end portion;

(b) wound around said photosensitive body along said feed direction;

(c) capable of being peeled off from said photosensitive surface; and (d) having on its surface a mark to be detected magnetically.

3. An endless belt type photosensitive body as claimed in claim 2, wherein said mark is a magnetic body.

4. An endless belt type photosensitive body as claimed in claim 2, wherein said first end portion is made from an elastic material.

5. An endless belt type photosensitive body as claimed in claim 2, wherein said mark is provided at said first end portion.

6. An endless belt type photosensitive body as claimed in claim 2, wherein said mark is provided at said second end portion.

7. A drum type photosensitive body to be mounted on an electrophotographic printer so as to be rotated in a predetermined direction and having on its outer surface a photosensitive surface that is covered with a protection film characterized as follows:

(a) having a first end portion and a second end portion at the upstream side and the downstream side of said rotation direction and entirely adhered to said photosensitive surface except for said first end portion;

(b) wound around said photosensitive body along said rotary direction;

(c) capable of being peeled off from said photosensitive surface; and (d) having on its surface a mark to be detected magnetically.

8. An drum type photosensitive body as claimed in claim 7, wherein said mark is a magnetic body.

9. An drum type photosensitive body as claimed in claim 7, wherein said first end portion is made from an elastic material.

10. An drum type photosensitive body as claimed in claim 7, wherein said mark is provided at said first end portion.

11. An drum type photosensitive body as claimed in claim 7, wherein said mark is provided at said second end portion.

12. An endless belt type photosensitive body to be mounted on an electrophotographic printer so as to be fed in a predetermined direction and having on its outer surface a photosensitive surface that is covered with a protection film characterized as follows:

(a) having a first end portion and a second end portion at the upstream side and the downstream side of said feed direction and entirely adhered to said photosensitive surface except for said first end portion;

(b) wound around said photosensitive body along said rotary direction;

(c) capable of being peeled off from said photosensitive surface; and (d) having on its surface a mark to be detected optically.

13. An endless belt type photosensitive body as claimed in claim 12, wherein said mark is made from a transparent material for transmitting a light through a depth of said protection film.

14. An endless belt type photosensitive body as claimed in claim 12, wherein said mark is made from a material for reflecting a light.

15. An endless belt type photosensitive body as claimed in claim 12, wherein said first end portion is made from an elastic material.

16. An endless belt type photosensitive body as claimed in claim 12, wherein said mark is provided in said first end portion.

17. An endless belt type photosensitive body as claimed in claim 12, wherein said mark is provided in said second end portion.

18. A drum type photosensitive body to be mounted on an electrophotographic printer so as to be rotated in a predetermined direction and having on its outer surface a photosensitive surface that is covered with a protection film characterized as follows:

(a) having a first end portion and a second end portion at the upstream side and the downstream side of said rotation direction and entirely adhered to said photosensitive surface except for said first end portion;

(b) wound around said photosensitive body along said rotary direction;

(c) capable of being peeled off from said photosensitive surface; and (d) having on its surface a mark to be detected optically.

19. A drum type photosensitive body as claimed in claim 18, wherein said mark is made from a transparent material for transmitting a light through a depth of said protection film.

20. A drum type photosensitive body as claimed in claim 18, wherein said mark is made from a material for reflecting a light.

21. A drum type photosensitive body as claimed in claim 18, wherein said first end portion is made from an elastic material.

22. A drum type photosensitive body as claimed in claim 18, wherein said mark is provided in said first end portion.

23. A drum type photosensitive body as claimed in claim 18, wherein said mark is provided in said second end portion.

24. An electrophotographic printer on which said photosensitive body claimed in claim 2 is detachably mounted, said printer comprising:

(a) a peel member having a slanting plane to guide said first end portion in a direction apart from said photosensitive surface, (b) a guide route defined by said slanting plane and its extension for guiding said protection film out of said electrophotographic printer, (c) a feed roller for moving said protection film through said guide route, and (d) a magnetic sensor provided in said guide route for detecting passage of said mark.

25. An electrophotographic printer as claimed in claim 24, said printer further comprising a control circuit for controlling a printing operation and a state display block for indicating whether said protection film has been peeled off from said photosensitive body correctly, said control circuit having a peel-off state decision function to control said state display block so as to display a message telling a normal removal if said mark is detected by said magnetic sensor.

26. An electrophotographic printer as claimed in claim 24, said printer further comprising a control circuit for controlling a printing operation and a state display block for indicating whether said protection film has been peeled off from said photosensitive body correctly, said control circuit having a peel-off state decision function as follows:

(a) if said magnetic sensor detects said mark within a predetermined time after said photosensitive body is mounted and rotated, said peel-off state decision function controls said state display block to display a massage telling a normal removal; and (b) if said magnetic sensor does not detect said mark within a predetermined time after said photosensitive body is mounted and rotated, said peel-off state decision function controls said state display block to display a message telling a removal error.

27. An electrophotographic printer as claimed in claim 26, wherein said control circuit has:

a counter function for counting and storing a number of sheets printed each time printing is carried out; and an initialization function for initializing said count of said counter function when said magnetic sensor has detected said mark.

28. An electrophotographic printer as claimed in claim 27, said printer further comprising a replacement display unit which is controlled by said control circuit to display a message for replacing the photosensitive body when said count of said counter function exceeds a predetermined count value.

29. An electrophotographic printer on which said photosensitive body claimed in claim 7 is detachably mounted, said printer comprising:

(a) a peel member having a slanting plane to guide said first end portion in a direction apart from said photosensitive surface, (b) a guide route defined by said slanting plane and its extension for guiding said protection film out of said electrophotographic printer, (c) a feed roller for moving said protection film through said guide route, and (d) a magnetic sensor provided in said guide route for detecting passage of said mark.

30. An electrophotographic printer as claimed in claim 29, said printer further comprising a control circuit for controlling a printing operation and a state display block for indicating whether said protection film has been peeled off from said photosensitive body correctly, said control circuit having a peel-off state decision function to control said state display block so as to display a message telling a normal removal if said mark is detected by said magnetic sensor.

31. An electrophotographic printer as claimed in claim 29, said printer further comprising a control circuit for controlling a printing operation and a state display block for indicating whether said protection film has been peeled off from said photosensitive body correctly, said control circuit having a peel-off state decision function as follows:

(a) if said magnetic sensor detects said mark within a predetermined time after said photosensitive body is mounted and rotated, said peel-off state decision function controls said state display block to display a massage telling a normal removal; and (b) if said magnetic sensor does not detect said mark within a predetermined time after said photosensitive body is mounted and rotated, said peel-off state decision function controls said state display block to display a message telling a removal error.

32. An electrophotographic printer as claimed in claim 31, wherein said control circuit has:

a counter function for counting and storing a number of sheets printed each time printing is carried out; and an initialization function for initializing said count of said counter function when said magnetic sensor has detected said mark.

33. An electrophotographic printer as claimed in claim 32, said printer further comprising a replacement display unit which is controlled by said control circuit to display a message for replacing the photosensitive body when said count of said counter function exceeds a predetermined count value.

34. An electrophotographic printer on which said photosensitive body claimed in claim 12 is detachably mounted, said printer comprising:

(a) a peel member having a slanting plane to guide said first end portion in a direction apart from said photosensitive surface, (b) a guide route defined by said slanting plane and its extension for guiding said protection film out of said electrophotographic printer, (c) a feed roller for moving said protection film through said guide route, and (d) a optical sensor provided in said guide route for detecting passage of said mark.

35. An electrophotographic printer as claimed in claim 34, said printer further comprising a control circuit for controlling a printing operation and a state display block for indicating whether said protection film has been peeled off from said photosensitive body correctly, said control circuit having a peel-off state decision function to control said state display block so as to display a message telling a normal removal if said mark is detected by said optical sensor.

36. An electrophotographic printer as claimed in claim 34, said printer further comprising a control circuit for controlling a printing operation and a state display block for indicating whether said protection film has been peeled off from said photosensitive body correctly, said control circuit having a peel-off state decision function as follows:

(a) if said optical sensor detects said mark within a predetermined time after said photosensitive body is mounted and rotated, said peel-off state decision function controls said state display block to display a massage telling a normal removal; and (b) if said optical sensor does not detect said mark within a predetermined time after said photosensitive body is mounted and rotated, said peel-off state decision function controls said state display block to display a message telling a removal error.

37. An electrophotographic printer as claimed in claim 36, wherein said control circuit has:

a counter function for counting and storing a number of sheets printed each time printing is carried out; and an initialization function for initializing said count of said counter function when said optical sensor has detected said mark.

38. An electrophotographic printer as claimed in claim 37, said printer further comprising a replacement display unit which is controlled by said control circuit to display a message for replacing the photosensitive body when said count of said counter function exceeds a predetermined count value.

39. An electrophotographic printer on which said photosensitive body claimed in claim 18 is detachably mounted, said printer comprising:

(a) a peel member having a slanting plane to guide said first end portion in a direction apart from said photosensitive surface, (b) a guide route defined by said slanting plane and its extension for guiding said protection film out of said electrophotographic printer, (c) a feed roller for moving said protection film through said guide route, and (d) a optical sensor provided in said guide route for detecting passage of said mark.

40. An electrophotographic printer as claimed in claim 39, said printer further comprising a control circuit for controlling a printing operation and a state display block for indicating whether said protection film has been peeled off from said photosensitive body correctly, said control circuit having a peel-off state decision function to control said state display block so as to display a message telling a normal removal if said mark is detected by said optical sensor.

41. An electrophotographic printer as claimed in claim 39, said printer further comprising a control circuit for controlling a printing operation and a state display block for indicating whether said protection film has been peeled off from said photosensitive body correctly, said control circuit having a peel-off state decision function as follows:

(a) if said optical sensor detects said mark within a predetermined time after said photosensitive body is mounted and rotated, said peel-off state decision function controls said state display block to display a massage telling a normal removal; and (b) if said optical sensor does not detect said mark within a predetermined time after said photosensitive body is mounted and rotated, said peel-off state decision function controls said state display block to display a message telling a removal error.

42. An electrophotographic printer as claimed in claim 41, wherein said control circuit has:

a counter function for counting and storing a number of sheets printed each time printing is carried out; and an initialization function for initializing said count of said counter function when said optical sensor has detected said mark.

43. An electrophotographic printer as claimed in claim 42, said printer further comprising a replacement display unit which is controlled by said control circuit to display a message for replacing the photosensitive body when said count of said counter function exceeds a predetermined count value.

* * * * *

Disclaimer 6,124,065—Tomoya Saeki, Niigata, Japan. PHOTOSENSITIVE BODY AND ELECTROPHOTOGRAPHIC PRINTER USING THE SAME. Patent dated September 26, 2000. Disclaimer filed November 17, 2000, by the assignee, NEC Corporation.

Hereby enters this disclaimer to claims 1-43 of said patent.

(*Official Gazette*, January 16, 2001)